US007210520B2

(12) United States Patent
Yamanaka et al.

(10) Patent No.: US 7,210,520 B2
(45) Date of Patent: May 1, 2007

(54) HEAT EXCHANGER

(75) Inventors: Yasutoshi Yamanaka, Kariya (JP); Haruhiko Watanabe, Chiryu (JP); Naoki Ueda, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/060,603

(22) Filed: Feb. 17, 2005

(65) Prior Publication Data

US 2005/0194119 A1 Sep. 8, 2005

(30) Foreign Application Priority Data

Feb. 23, 2004 (JP) ..... 2004-046828

(51) Int. Cl.
*F28F 9/02* (2006.01)

(52) U.S. Cl. ..... 165/173; 165/153

(58) Field of Classification Search ..... 165/67, 165/173, 175, 151–153
See application file for complete search history.

(56) References Cited

U.S. PATENT DOCUMENTS 6,604,574 B1 * 8/2003 Loomis et al. ..... 165/173
2006/0086486 A1 * 4/2006 Sudo ..... 165/143

FOREIGN PATENT DOCUMENTS

| | | |
|---|---|---|
| EP | 0641 985 | 3/1995 |
| GB | 2 285 858 | 7/1995 |
| JP | 2-309196 | 12/1990 |
| JP | 8-296990 | 11/1996 |

* cited by examiner

*Primary Examiner*—Teresa J. Walberg
(74) *Attorney, Agent, or Firm*—Harness, Dickey & Pierce, PLC

(57) ABSTRACT

A heat exchanger according to the present invention has a plurality of tubes, header tanks and a support. Fluid flows through the plurality of tubes. The header tanks have a core plate and a tank body, and are disposed at longitudinal end portions of the plurality of tubes in such a manner to be communicated with internal spaces of the plurality of tubes. The core plate has approximately arc-shaped cross-section of which both side fringes are fixed onto the tank body and of which a middle portion fixes the longitudinal end portions of the plurality of tubes therein and bulges with respect to the both side fringes toward the plurality of tubes. The tank body and the core plate form an internal space of each of the header tanks. The support retains an interval between the both side fringes.

7 Claims, 5 Drawing Sheets

HEAT EXCHANGER

CROSS REFERENCE TO RELATED APPLICATION

This application is based upon and claims the benefit of priority of Japanese Patent Application No. 2004-046828 filed on Feb. 23, 2004, the content of which is incorporated herein by reference.

FIELD OF THE INVENTION

The present invention relates to a heat exchanger, which can effectively be applied to an intercooler for cooling air (intake air) before introduced into an internal combustion engine to support combustion.

BACKGROUND OF THE INVENTION

A conventional heat exchanger for cooling intake air pressurized by a supercharger before introduced into an internal combustion engine has a core portion having a plurality of tubes and serving as a heat exchanging portion and a header tank communicated with the plurality of tubes in the core portion.

FIG. 8 depicts a sectional view of an example of a structure of the above header tank. A core plate 911 to which a tube 922 is blazed and a tank body 912 are joined to each other to form the header tank 910 and a chamber 910*a* therein. Two side walls 912*b* at both sides of the tank body 912 are supported by a support bar 912*a* disposed therebetween and joined thereto such by welding, in a manner of penetrating the chamber 910*a*.

Recent emission regulation requires to increase boost pressure. If the header tank 910 does not have the support bar 912*a*, the boost pressure may deform the tank body 912 to bulge outward, and also deform the core plate 911 to increase a distance between edges 911*b* thereof. This deformation generates a large stress at a connection 911*a* of the core plate 911 and the tube 922 inducing defect such as a fracture at the connection. The support bar 912*a* is for preventing the above defect.

However, the above conventional heat exchanger requires to bore the tank body 912 for fixing the support bar 912*a* and to weld the support bar 912*a* to the tank body 912 in a manner of securing the airtightness. The structure of the above heat exchanger makes the manufacture complex and increases manufacturing facilities and the manufacturing processes of the heat exchanger.

The inventors of the present invention has focused attention on stress reduction generating at the connection of the core plate and the tube, and discovered a heat exchanger capable of reducing the stress at the connection without the support bar and just by limiting deformation of only the core plate.

SUMMARY OF THE INVENTION

It is therefore an object of the present invention is to provide a heat exchanger for reducing stress at a connection of a core plate and a tube of the heat exchanger without using a bulging limiter of a tank body of the heat exchanger.

To achieve the above object, a heat exchanger according to the present invention comprises a plurality of tubes, header tanks and a support.

Fluid flows through the plurality of tubes.

The header tanks have a core plate and a tank body, and are disposed at longitudinal end portions of the plurality of tubes in such a manner to be communicated with internal spaces of the plurality of tubes. The core plate has approximately arc-shaped cross-section of which both side fringes are fixed onto the tank body and of which a middle portion fixes thereon the longitudinal end portions of the plurality of tubes and bulges with respect to the both side fringes toward the plurality of tubes. The tank body and the core plate form an internal space of each of the header tanks.

The support retains an interval between the both side fringes.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS (First Embodiment)

Figure 1:
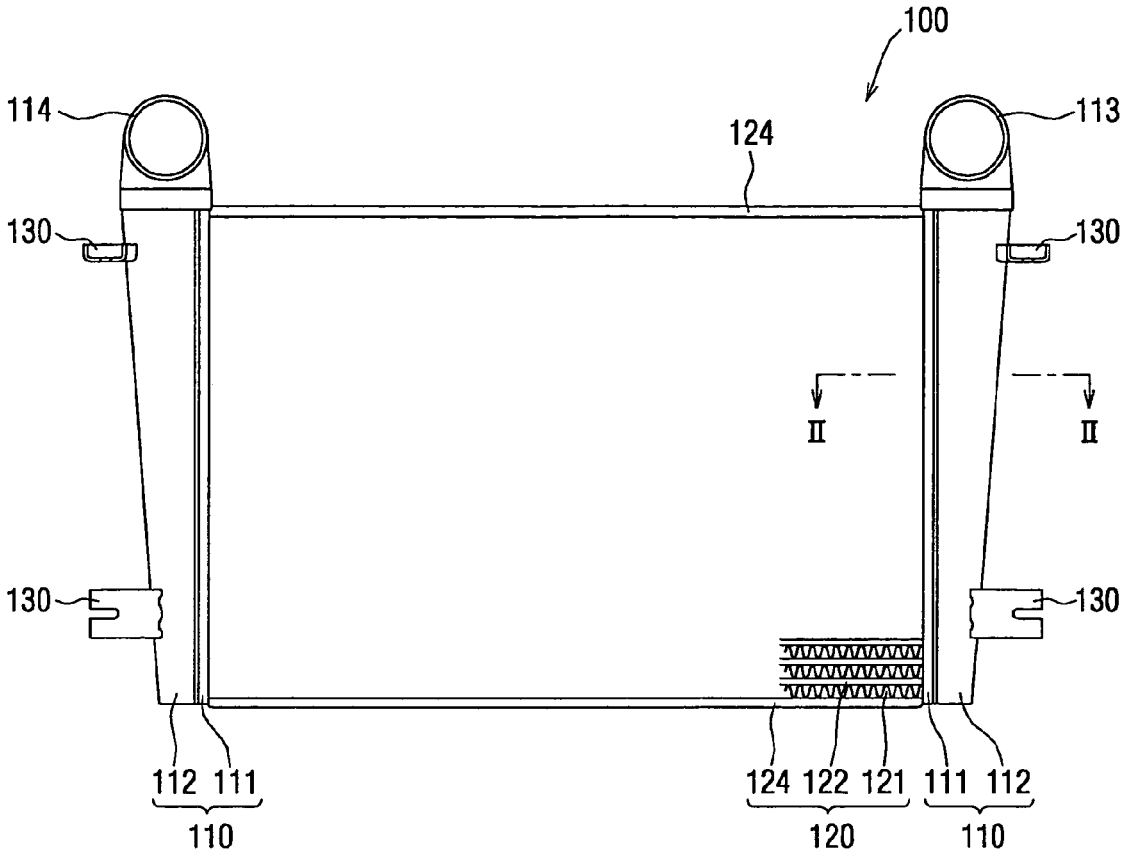
FIG. 1 is a front view of an intercooler, or a heat exchanger according to a first embodiment of the present invention.
Figure 2:
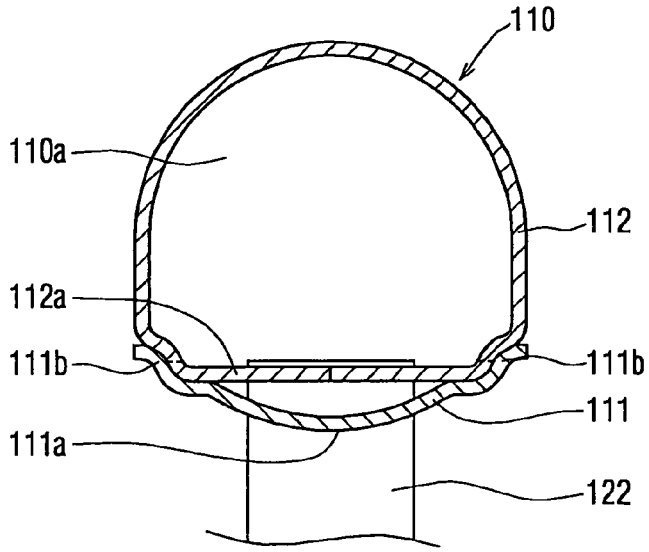
FIG. 2 is a sectional view taken along the line ll—ll in FIG. 1.

In a first embodiment of the present invention, a heat exchanger according to the present invention is applied to an intercooler 100 shown in FIGS. 1 and 2. The intercooler 100 is for cooling intake air pressurized by a supercharger before induced into an internal combustion engine. FIG. 1 shows therein a part of a core portion 120 of the intercooler 100, which will be described below.

As shown in FIG. 1, the intercooler 100 has the core portion 120 and a pair of header tanks 110 located at a left and a right sides of the core portion 120. The core portion 120 has outer fins 121 and tubes 122 that are laterally disposed between the header tanks 110 and alternately stacked. A pair of side plates 124 is disposed outside of an uppermost and a lowermost outer fins 121 as reinforcements. The above components in the core portion 120 are brazed to each other to be an unit.

The header tanks 110 are disposed at both ends of the tubes 122, which are arranged perpendicular to the header tanks 110, so as to communicate insides of the header tanks 110 with those of the tubes 122. Both end portions of each tubes 122 are inserted into and brazed to bores (not shown) formed in core plates 111 of the header tanks 110.

The tube 122 is fabricated in a planular shape by snapping a pair of channel-shape plates into each other so that their openings come closer to each other and brazing them. Inner fins (not shown) are brazed in the tubes 122, and the outer fins 121 are brazed on outer surfaces of the tubes 122. The outer fins 121 and the inner fins are made of copper having a required large thermal conductivity, and the tubes 122 and the side plates are made of alloys of copper having a required strength and thermal conductivity.

Each of the header tanks 110 is fabricated with the core plate 111 made of 3 mm thick alloys of copper, a tank body 112 and a bottom part (not shown). The core plate 111 and the tank body 112 are brazed or welded onto each other to form an internal space therein. The detailed structure of the header tank 110 will be described below.

A right-hand side header tank 110 in FIG. 1 is for distribution and supply of the intake air to the respective tubes 122 whereas a left-hand side header tank 110 in FIG. 1 is for collecting the intake air flowing out of the tubes 122. The right-hand side header tank has an inlet connector 113 in communication with the inside thereof, and the left-hand side header tank has an outlet connector 114 in communication with the inside thereof. The inlet connector 113 is connected to a discharge port of a supercharger (not shown), and the outlet connector 114 is connected to an intake port of an engine (not shown).

The cross-sectional area of internal space 110*a* of the header tank 110 gradually decreases in a longitudinal direction thereof as going away from the inlet/outlet connector 113, 114, so as to equalize the airflow in the respective tubes 122.

Stays 130 are fixed on each of the header tanks 110 at the outer side of the intercooler 100, for fixing the intercooler 100 onto the structural member of a vehicle.

The respective components of the core portion 120 are assembled together with the core plate 111 by snapping, by assembly jigs or by fixing, then brazed to be one body with a blazing paste clad on the desirable portion. Then the tank body 112 is welded onto the core plate 111 to be the intercooler 100.

Figure 3A:
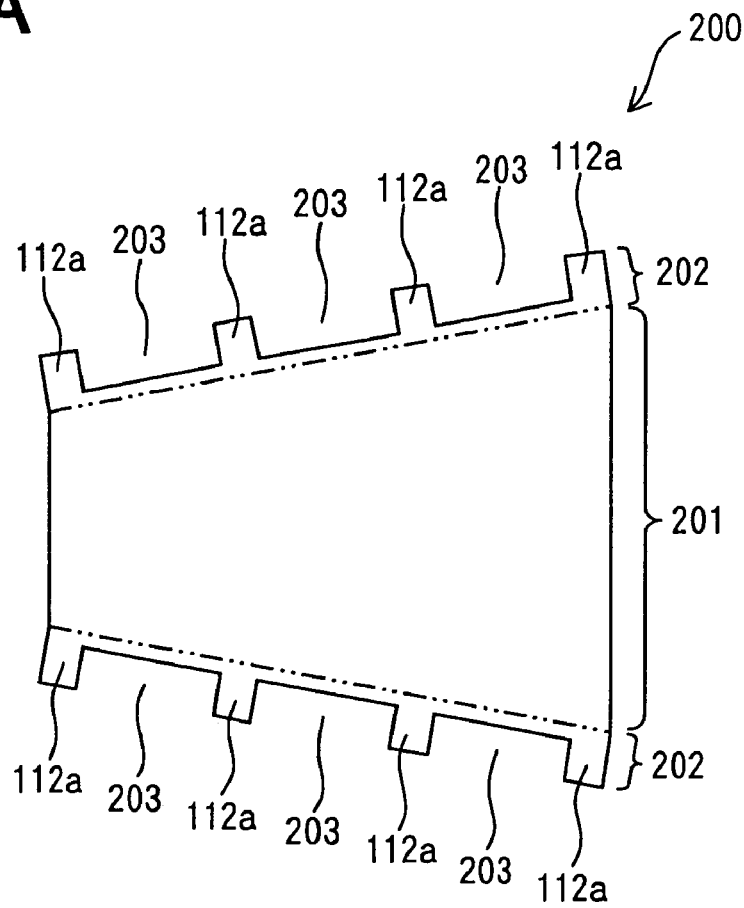
FIG. 3A is a schematic developed view of a tank in the first embodiment.
Figure 3B:
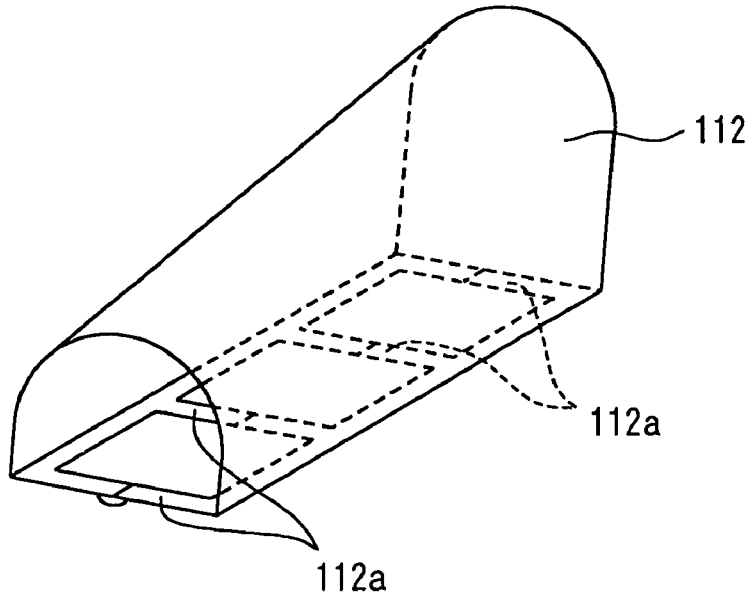
FIG. 3B is a schematic perspective view of the tank in the first embodiment.

The present invention is characterized in a structure of the header tank 100. The detailed structure will be described hereinafter with reference to FIGS. 2, 3A and 3B. FIGS. 3A and 3B depict the forming process of the tank body 112 of the header tank 110.

As shown in FIG. 2, the header tank 110 is assembled with the core plate 111 and the tank body 112, and has the internal space 110*a* therein. The core plate 111 has approximately arc-shaped cross-section, of which a middle portion 111*a* bulges with respect to both side fringes 111*b* (interposing the middle portion 111*a*) toward longitudinal middle portions of the tubes 122. The tank body 112 has approximately U-shaped cross-section. Both sides of a support 112*a* are fixed onto the fringes 111*b* of the core plate 111.

The tank body 112 including the support 112*a* is formed from a sheet material 200 shown in FIG. 3A. The sheet material 200 has a body portion 201 for forming the tank body 112 and a pair of support portions 202 interposing the body portion 201 therebetween and for forming the support 112*a*. Each of the support portions 202 has a plurality of rectangular notches 203 disposed at a predetermined interval. The portions for forming the support 112*a* interpose the notches 203.

The notches 203 can be formed in punch pressing the sheet material 200 and also be formed by cutting off portions corresponding to the notches 203 from a sheet material punch pressed in an approximately trapezoid shape. The body portion 201 has an approximately trapezoid shape whose width decreased from a right side to a left side thereof in FIG. 3A, so as to form the header tank 110 having the internal space 110*a* of which a cross-sectional area gradually decreases in the longitudinal direction thereof as going away from the inlet/outlet connector 113, 114 as described above.

The sheet material 200 shown in FIG. 3A is bended to form the approximately U-shaped tank body 112. Then, a pair of the support 112*a* extending out from the U-shaped body portion 201 are butt-joined to each other by welding, etc. FIG. 3B depicts an outline of the tank body 112 and the support 112*a*, wherein a thickness and a detailed shape of each component are not shown.

The header tank 110 is assembled by fixing the tank body 112 formed with the support 112*a* in a body onto the fringes 111*b* of the core plate 111. Here, the support 112*a* are connected to the fringes 111*b* of the core plate 111, so as to retain an interval between a pair of the fringes 111*b*.

The above configurations and manufacturing method of the heat exchanger 100 serves to reduce the deformation of the core plate 111, that is, an increase or a decrease of an interval between a pair of the fringes 1*b*, even when a large intake air pressure acts on the internal space 110*a* of the header tank 110. Thus, stress generating at a connection part (the middle portion) 111*a* of the core plate 111 and the tubes 122 is also reduced.

The inventors of the present invention have confirmed by an experiment that the intercooler 100 in the first embodiment endures a cyclic intake air pressure fluctuating between 0 kPa and 500 kPa more than 600,000 times, causing no malfunction such as a crack generation at the connection part 111*a* of the core plate 111 and the tubes 122.

Figure 8:
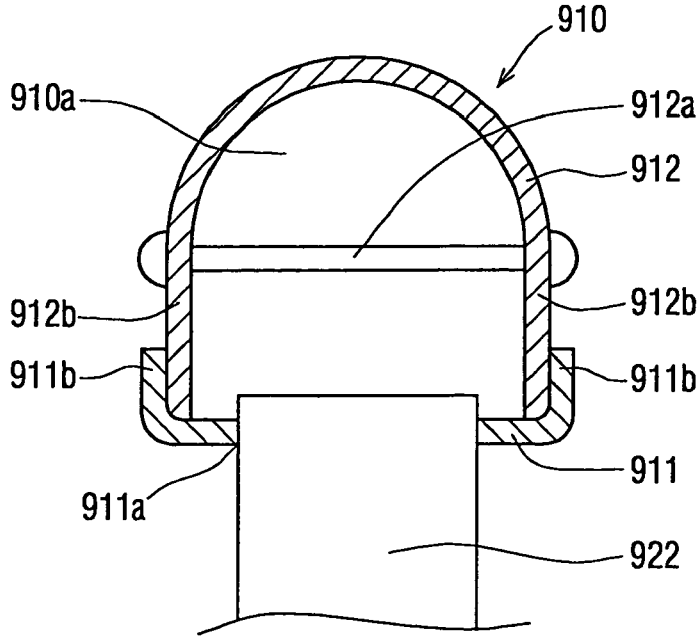
FIG. 8 PRIOR ART
FIG. 8 is a sectional view of a principal part in a conventional intercooler.

The support 112*a* reduces the deformation of the core plate 111, not by retaining an interval between two side walls at both sides of the tank body 112, but by retaining the interval between a pair of the fringes 111*b*. Thus, it is not necessary to form bores on the side walls of the tank body 112, to dispose a support bar between the bores and to weld the support bar onto the side walls so as to secure airtightness, as shown in FIG. 8.

Further, the support 112*a* is formed in a body together with the tank body 112, and fixed onto the core plate 111 in assembling the header tank 110 by connecting the core plate 111 and the tank body 112. This configuration reduces manufacturing processes than a conventional method of making the support 112*a* separately and fixing the support 112*a* onto the core plate 111.

Furthermore, the tank body 112 having the support 112*a* in a body can be easily manufactured from the sheet material 200.

(Second Embodiment)

Figure 4:
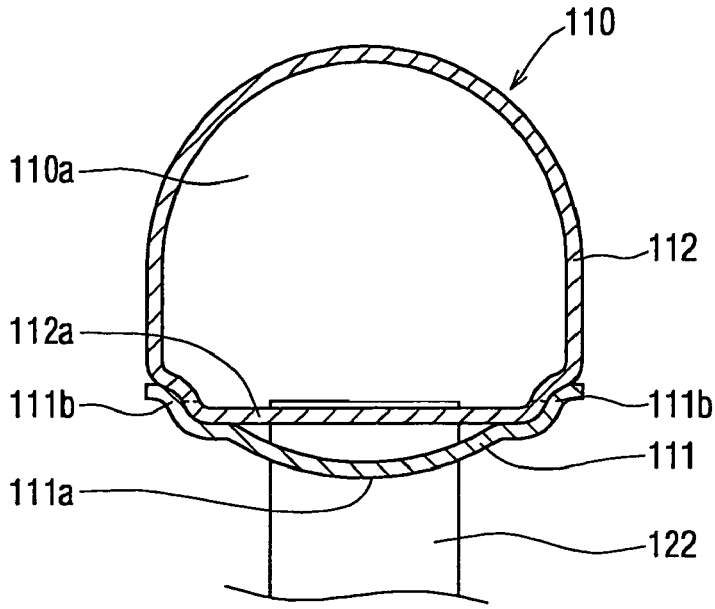
FIG. 4 is a sectional view of a principal part of an intercooler according to a second embodiment of the present invention.
Figure 5:
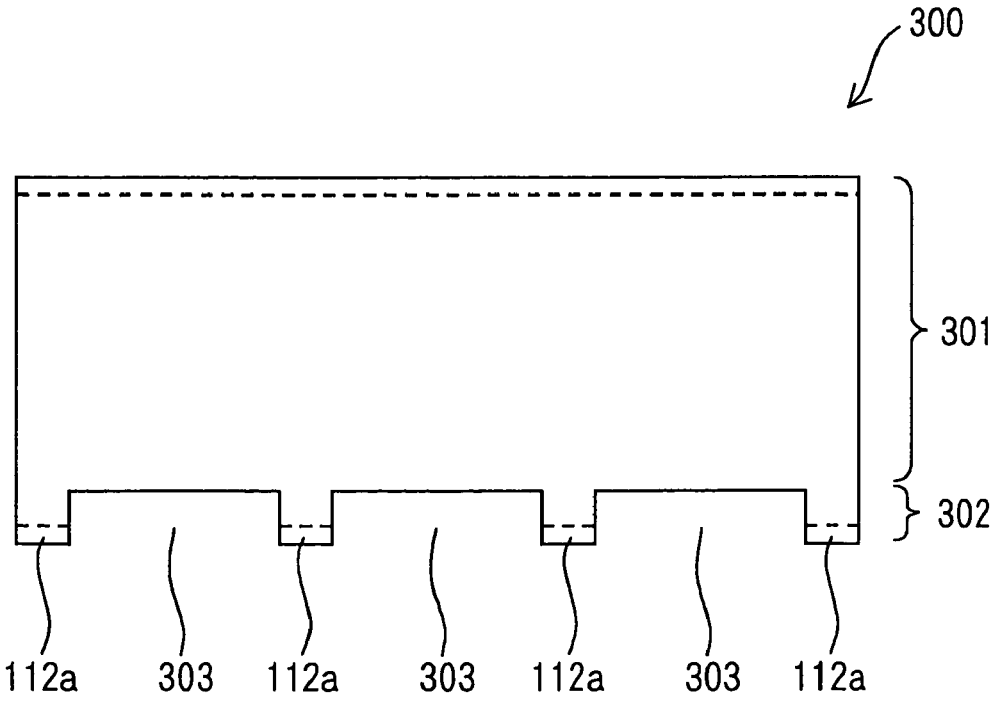
FIG. 5 is a schematic side view of a cylinder in the second embodiment.

A heat exchanger according to a second embodiment differs from that in the first embodiment in having a tank body 112 and a support 112*a* shown in FIGS. 4 and 5 that are not formed from a sheet material.

The tank body 112 and the support 112*a* in the second embodiment is formed in a cylinder 300 of which an outline is shown in FIG. 5 and made of alloys of copper. The cylinder 300 is formed by hydroforming into a shape having a cross-section shown in FIG. 4. The cylinder 300 has a body portion 301 and a support portion 302 integrally as shown in FIG. 5. The support portion 302 has a plurality of approximately rectangular openings 303 disposed at a predetermined interval. The openings 303 are formed by cutting respective parts of the support portion 302 by cutting work, laser beam machining, etc. The portions for forming the support 112*a* interpose the openings 303.

The header tank 110 is assembled by fixing the tank body 112 formed with the support 112*a* in a body as described above onto the fringes 111*b* of the core plate 111 as shown in FIG. 4. Here, the support 112*a* are connected to the fringes 111*b* of the core plate 111, so as to retain an interval between a pair of the fringes 111*b*.

In the second embodiment, the tank body 112 of the header tank 110 is formed in the cylinder 300, therefore, has an approximately uniform diameter in a longitudinal direction thereof.

The above configurations and manufacturing method of the heat exchanger, as in the case of the first embodiment, serves to reduce the deformation of the core plate 111, that is, an increase or a decrease of an interval between a pair of the fringes 111*b*, even when a large intake air pressure acts on the internal space 110*a* of the header tank 110. Thus, stress generating at a connection part (the middle portion) 111*a* of the core plate 111 and the tubes 122 is also reduced.

Further, the support 112*a* is formed in a body together with the tank body 112, and fixed onto the core plate 111 in assembling the header tank 110 by connecting the core plate 111 and the tank body 112. This configuration reduces manufacturing processes than a conventional method of making the support 112*a* separately and fixing the support 112*a* onto the core plate 111.

Furthermore, the tank body 112 having the support 112*a* in a body can be easily manufactured from the sheet material 200.

Other Embodiments

Figure 6:
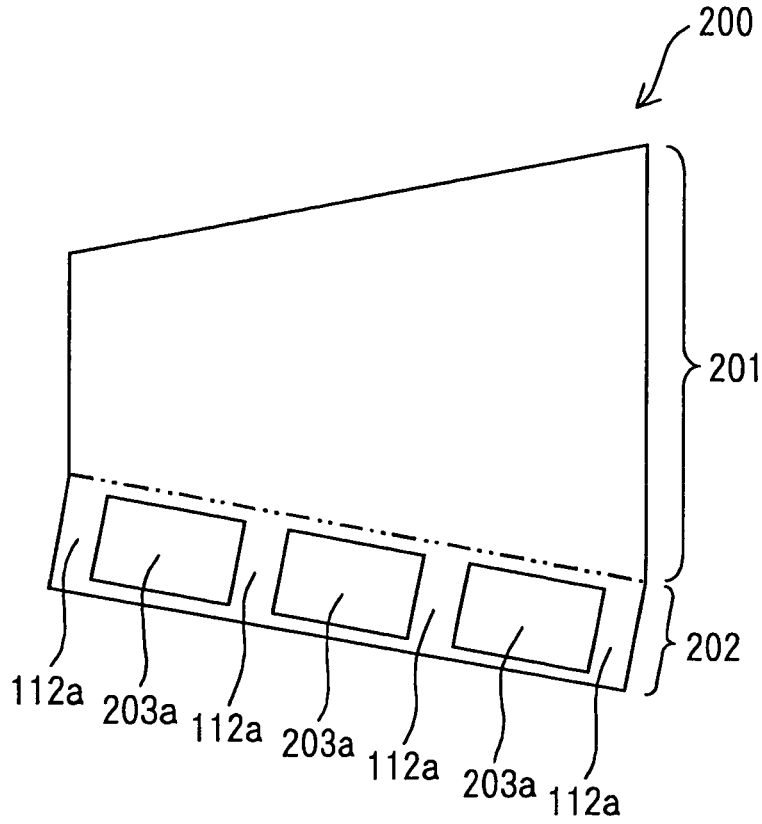
FIG. 6 is a schematic developed view of a plate in another embodiment.

In the first embodiment, the sheet material 200 has a pair of the support portions 202 in a manner of interposing the body portion 201. However, the header tank 110 may be formed from a sheet material having a body portion for forming the tank body 112 and a support portion (support portions) for forming the support 112*a* that are arranged in a different manner from that of the sheet material 200. For example, as shown in FIG. 6, the header tank 110 may be formed from a sheet material 200 having one support portion 202 at one side of a body portion 201. The support portion 202 of the sheet material 200 has a plurality of rectangular openings 203*a* disposed at a predetermined interval. It is not necessary to connect a plurality of support portions 112*a* as in the first embodiment.

Figure 7A:
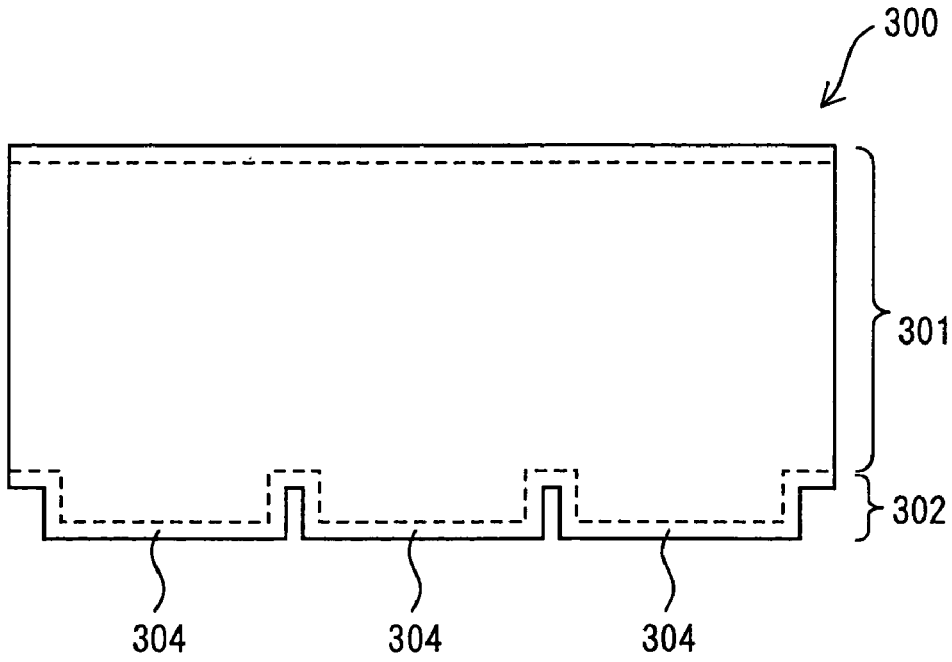
FIG. 7A is a schematic side view showing a forming process of a cylinder in another embodiment.
Figure 7B:
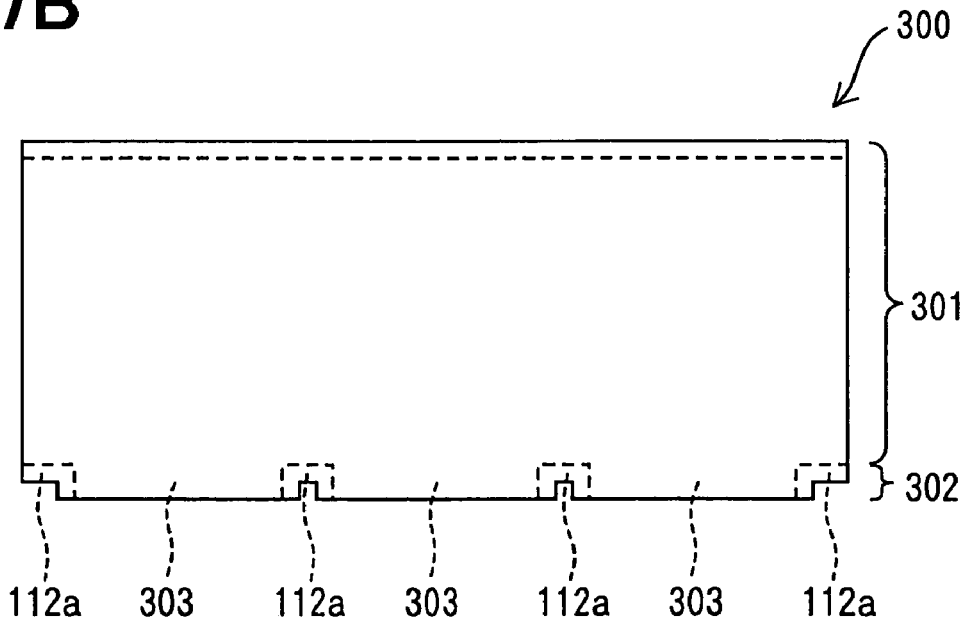
FIG. 7B is a schematic side view showing the forming process of the cylinder in the other embodiment.

The second embodiment adopts the cylinder 300 formed by metalforming into a shape having an approximately uniform cross-section in the longitudinal direction thereof and cutting respective parts of the openings 303. However, the header tank 110 may be formed from a cylinder shaped in a different manner. For example, as shown in FIG. 7A, the header tank 110 may adopt a cylinder 300 formed by metalforming to have bulging portions 304 at positions where openings are to be provided and cutting the bulging portions 304 to provide the openings 303 as shown in FIG. 7B.

The supports 112*a*, which are formed together with the tank body 112 in a body in the above embodiments, may be formed separately from the tank body 112.

The core plate 111, the tank body 112, the supports 112*a*, the tube 122, etc., which are made of alloys of copper in the above embodiments, also may be made of other metallic materials such as alloys of aluminum. However, alloys of copper is more suitable for cooling the supercharged air having high temperature and large pressure, than alloys of aluminum whose strength decreases in an environment of high temperature is more than that of alloys of copper.

The present invention, which is explained as an intercooler 100 in the above embodiments, may be adopted other kinds of heat exchanger such as an oil cooler.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A heat exchanger comprising:

a plurality of tubes through which fluid flows;

header tanks having a core plate and a tank body, and disposed at longitudinal end portions of the plurality of tubes in such a manner to be communicated with internal spaces of the plurality of tubes, the core plate having an approximately arc-shaped cross-section of which both side fringes are fixed onto the tank body and of which a middle portion fixes the longitudinal end portions of the plurality of tubes therein and having a bulged portion which bulges with respect to the both side fringes toward the plurality of tubes, and the tank body and the core plate forming an internal space of each of the header tanks; and a support retaining an interval between the both side fringes, the support extending linearly directly between both side fringes.

2. The heat exchanger according to claim 1, wherein the support is integrally formed together with the tank body in a body.

3. The heat exchanger according to claim 2, wherein the tank body is formed from a sheet plate punch pressed in a shape having a first portion for forming the tank body and a second portion adjoining to the first portion and part of which is cut off to leave a third portion for forming the support.

4. The heat exchanger according to claim 3, wherein the first portion has an approximately trapezoid shape of which a width gradually decreases in a longitudinal direction thereof, so as to make a cross-sectional area of the internal space gradually decreases in a longitudinal direction of the header tank as going away from a connector through which the fluid flows into or out of the header tank.

5. The heat exchanger according to claim 2, wherein the tank body is formed of a cylinder formed in a shape according to that of the header tank and having a first portion for forming the tank body and a second portion to be located between the both side fringes and part of which is cut off to leave a third portion for forming the support.

6. The heat exchanger according to claim 1, wherein the core plate and the tank body are made of metallic material.

7. The heat exchanger according to claim 6, wherein the core plate and the tank body are made of alloys of copper.

* * * * *